US012264555B2

(12) United States Patent
Aty et al.

(10) Patent No.: US 12,264,555 B2
(45) Date of Patent: Apr. 1, 2025

(54) AUTONOMOUS TUBING CASING ANNULUS RELIEF SYSTEM

(71) Applicant: SAUDI ARABIAN OIL COMPANY, Dhahran (SA)

(72) Inventors: Adel Aty, Dammam (SA); Ayman Qatari, Qatif (SA); Ahmed Al-Nwaeser, Safwa (SA); Rakan Al-Yateem, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 84 days.

(21) Appl. No.: 18/192,885

(22) Filed: Mar. 30, 2023

(65) Prior Publication Data

US 2024/0328280 A1 Oct. 3, 2024

(51) Int. Cl.
*E21B 34/02* (2006.01)
*E21B 47/06* (2012.01)

(52) U.S. Cl.
CPC ..... *E21B 34/02* (2013.01); *E21B 47/06* (2013.01)

(58) Field of Classification Search
None
See application file for complete search history.

(56) References Cited

U.S. PATENT DOCUMENTS 6,237,398 B1 5/2001 Porat et al.
7,721,822 B2 * 5/2010 Krueger ..... E21B 21/08 175/48
8,210,266 B2 * 7/2012 Younger ..... E21B 21/106 166/321
8,955,619 B2 * 2/2015 Tilton ..... E21B 21/14 175/48
9,051,809 B2 6/2015 Morrison
9,341,037 B2 * 5/2016 Suter ..... E21B 21/106
10,787,882 B2 * 9/2020 Olsen ..... E21B 34/025
11,261,712 B2 * 3/2022 Muraikhi ..... E21B 34/02
(Continued)

FOREIGN PATENT DOCUMENTS

CN 103745103 A 4/2014
CN 105019843 A 11/2015
(Continued)

*Primary Examiner* — Matthew R Buck
*Assistant Examiner* — Douglas S Wood
(74) *Attorney, Agent, or Firm* — Osha Bergman Watanabe & Burton LLP

(57) ABSTRACT

A system for relieving pressure in a wellbore annulus of a hydrocarbon recovery well includes a wellhead, a production line extending from the wellhead, and an annulus relief line extending between the wellhead and the production line. A first pressure gauge measures fluid pressure in the wellbore annulus, a second pressure gauge measures fluid pressure in the production line. A well control system is in communication with the first pressure gauge, second pressure gauge and a check valve disposed in the annulus relief line. The well control system opens and closes the check valve in response to a determined difference between fluid pressure measured by the first pressure gauge and fluid pressure measured by the second pressure gauge. A related method includes measuring the fluid pressure in the wellbore annulus and in the production line, and opening and closing the check valve in response to the determined pressure difference.

13 Claims, 5 Drawing Sheets

(56) References Cited

U.S. PATENT DOCUMENTS

| | | | | |
|---|---|---|---|---|
| 2005/0092523 | A1 | 5/2005 | McCaskill et al. | |
| 2012/0227961 | A1 | 9/2012 | Sehsah | |
| 2013/0068532 | A1* | 3/2013 | Bansal | E21B 21/019 175/218 |
| 2017/0356279 | A1* | 12/2017 | Nandola | E21B 41/00 |
| 2021/0332652 | A1* | 10/2021 | Muraikhi | E21B 33/068 |

FOREIGN PATENT DOCUMENTS

| | | | |
|---|---|---|---|
| CN | 105569632 | A | 5/2016 |
| WO | 2016/022069 | A2 | 2/2016 |
| WO | 2021/217182 | A1 | 10/2021 |

* cited by examiner

AUTONOMOUS TUBING CASING ANNULUS RELIEF SYSTEM

BACKGROUND

Generally, as known in the oilfield arts, a tubing casing annulus may be defined between a casing in a wellbore and tubing nested concentrically therewithin, such as production tubing. At times, there may be an undesirable buildup of fluid pressure within the annulus, warranting relief via a manual bleed-off operation via an outlet or tubing in communication with the annulus. However, a recurrent pattern of pressure buildup and relief within relatively short time frames may be difficult to manage, possibly involving a costly commitment of personnel and resources.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for relieving pressure in a wellbore annulus of a hydrocarbon recovery well. The system includes a wellhead disposed at a wellbore, a production line extending from the wellhead, and an annulus relief line in communication with the wellbore annulus, wherein the annulus relief line extends between the wellhead and the production line. A first pressure gauge measures fluid pressure in the wellbore annulus, a second pressure gauge that measures fluid pressure in the production line, and a check valve disposed in the annulus relief line. A well control system is in communication with the first pressure gauge, second pressure gauge and check valve. The well control system opens and closes the check valve in response to a determined difference between fluid pressure measured by the first pressure gauge and fluid pressure measured by the second pressure gauge.

In one aspect, embodiments disclosed herein relate to a method that includes placing an annulus relief line in communication with a wellbore annulus, such that the annulus relief line extends between a wellhead at a wellbore and a production line extending from the wellhead. Fluid pressure in the wellbore annulus is measured via a first pressure gauge, and fluid pressure in the production line is measured via a second pressure gauge. A check valve is disposed in the annulus relief line and, via a well control system in communication with the first pressure gauge, second pressure gauge and check valve, the check valve is opened and closed in response to a determined difference between fluid pressure measured by the first pressure gauge and fluid pressure measured by the second pressure gauge.

Other aspects and advantages of the claimed subject matter will be apparent from the following description and the appended claims.

DETAILED DESCRIPTION

Figure 1:
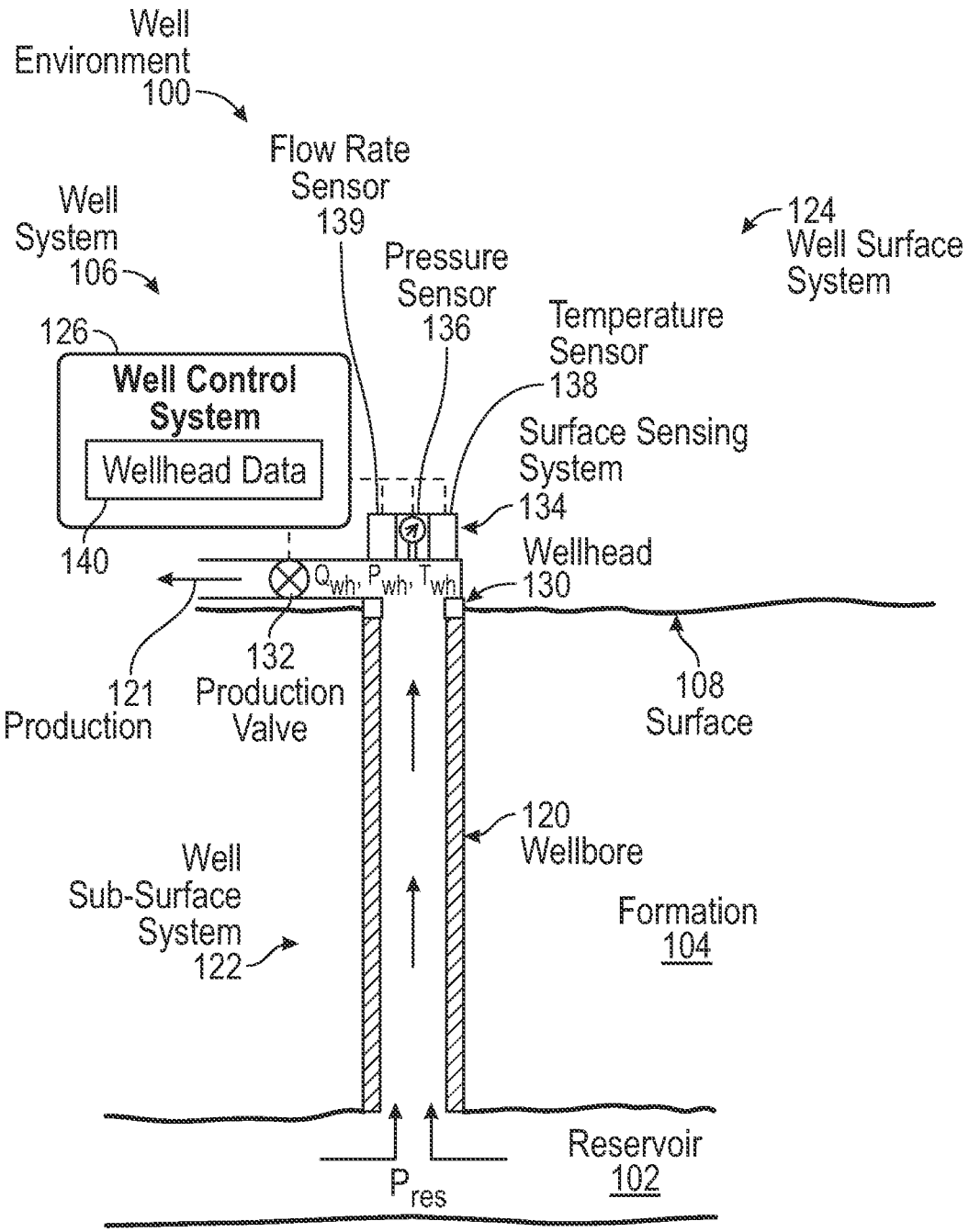
FIG. 1 schematically illustrates, in a cross-sectional elevational view, a conventional wellbore and well control system by way of general background and in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

To facilitate easier reference when describing FIGS. 1 through 5, reference numerals may be advanced by a multiple of 100 in indicating a similar or analogous component or element among FIGS. 1-5.

Broadly contemplated herein, in accordance with one or more embodiments, is the use of a relief line from an oil wellhead directly connected to a downstream production line system. The connected line contains a relief valve as well as a counter to further ensure integrity of a tubing casing annulus. In this connection, FIGS. 1 and 2 illustrate a general environment in which one or more embodiments may be employed.

Figure 2:
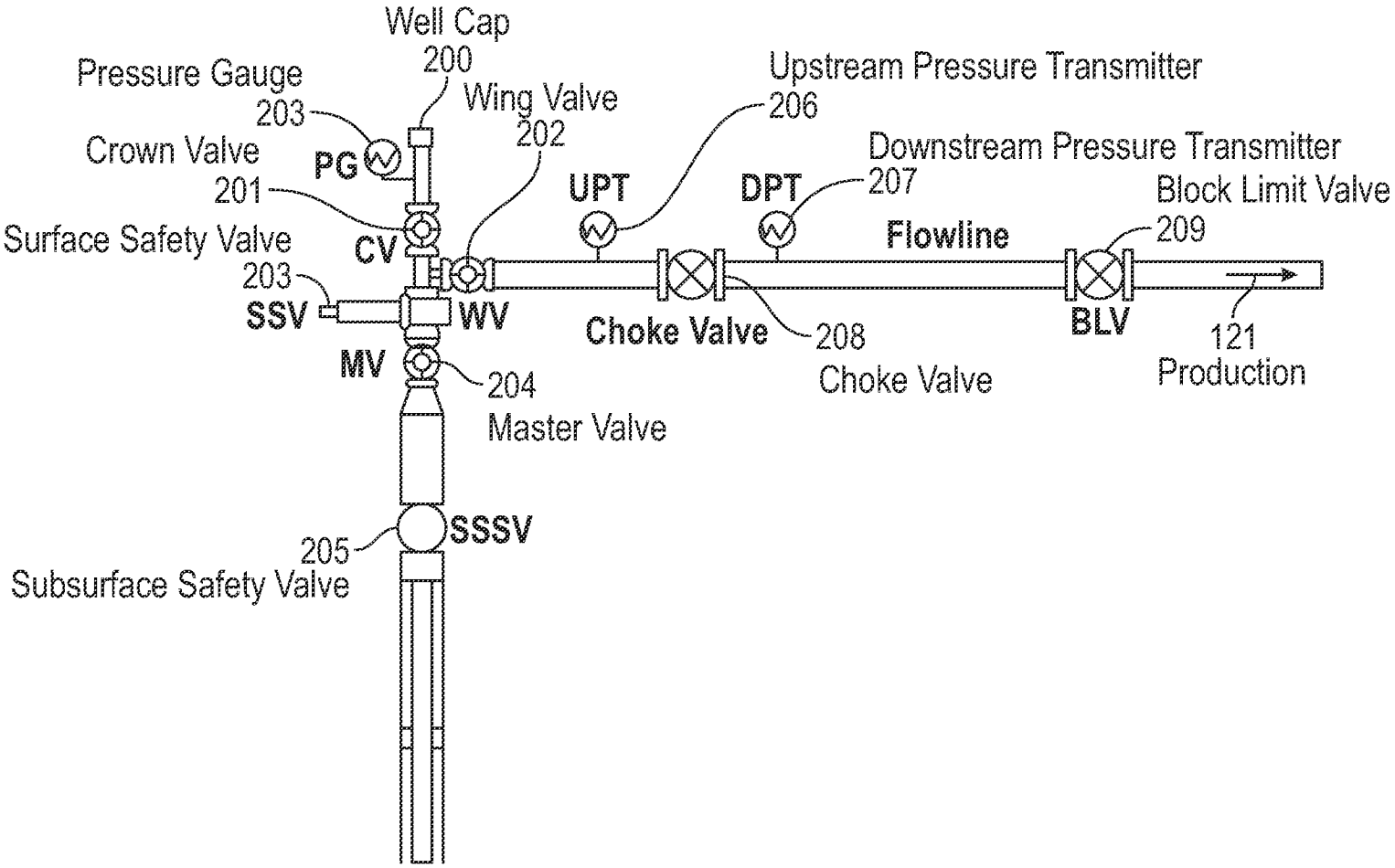
FIG. 2 illustrates, in elevational view, a wellhead, and related components, employed for the wellbore and well control system of FIG. 1, by way of general background and in accordance with one or more embodiments.

FIG. 1 schematically illustrates, in a cross-sectional elevational view, a wellbore and a well control system in accordance with one or more embodiments, at a hydrocarbon recovery well. The well system 106 includes a wellbore 120, a well sub-surface system 122, a well surface system 124, and a well control system ("control system") 126. The control system 126 may control various operations of the well system 106, such as well production operations, well completion operations, well maintenance operations, and reservoir monitoring, assessment and development operations. The control system 126 includes a computer system that is the same as, or is in communication with, computer system 585 described below in FIG. 5.

In accordance with one or more embodiments, the wellbore 120 includes a bore hole that extends from the surface 108 into a target zone of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "down-hole" end of the wellbore 120. The wellbore 120 facilitates the circulation of drilling fluids during drilling operations, the flow of hydrocarbon production ("production") 121 (e.g., oil and gas) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In accordance with one or more embodiments, during operation of the well system 106, the control system 126 collects and records wellhead data 140 for the well system 106. The wellhead data 140 may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well 106, and water cut data. Such measurements may be recorded in real-time, to be available for review or use within seconds, minutes, or hours of the condition being sensed (e.g., within one hour). Such real-time data can help an operator of the well 106 to assess a relatively current state of the well system 106, and make real-time decisions regarding development of the well system 106 and the reservoir 102, such as on-demand adjustments in regulation of production flow from the well. As will be discussed in greater detail below, a control system analogous to that indicated at 126 may also be used to obtain pressure measurements from different locations in a manner to control the opening and closing of an annulus relief line check valve.

In accordance with one or more embodiments, the well sub-surface system 122 includes a casing installed in the wellbore 120. For example, the wellbore 120 may have a cased portion and an uncased (or "open-hole") portion. The cased portion may include a portion of the wellbore having casing disposed therein. The uncased portion may include a portion of the wellbore not having casing disposed therein. In embodiments having a casing, the casing defines a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the formation 104. The well sub-surface system 122 can include production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In accordance with one or more embodiments, the well surface system 124 includes a wellhead 130. For the purposes of the present discussion, the term "wellhead" may be considered to be interchangeable with the terms "Christmas tree", "Xmas tree" or "X-tree" as generally known in the oilfield arts. The wellhead 130 may include a rigid structure installed at the "up-hole" end of the wellbore 120, at or near where the wellbore 120 terminates at the Earth's surface 108. The wellhead 130 may include structures (called "wellhead casing hanger" for casing and "tubing hanger" for production tubing) for supporting (or "hanging") casing and production tubing extending into the wellbore 120. Production 121 may flow through the wellhead 130, after exiting the wellbore 120 and the well sub-surface system 122, including, for example, the casing and the production tubing. The well surface system 124 may include flow regulating devices that are operable to control the flow of substances into and out of the wellbore 120. For example, the well surface system 124 may include one or more production valves 132 that are operable to control the flow of production 121. For instance, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

In accordance with one or more embodiments, the wellhead 130 includes a choke assembly. For example, the choke assembly may include hardware with functionality for opening and closing the fluid flow through pipes in the well system 106. Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system 126. Accordingly, a well control system 126 may obtain wellhead data regarding the choke assembly as well as transmit one or more commands to components within the choke assembly in order to adjust one or more choke assembly parameters.

In accordance with one or more embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flow rate of production 121 flowing through the wellhead 130, or other conduits of the well surface system 124, after exiting the wellbore 120.

In accordance with one or more embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" ($T_{wh}$). In some embodiments, the surface sensing system 134 includes a flow rate sensor 139 operable to sense the flow rate of production 121 flowing through the well surface system 124, after it exits the wellbore 120. The flow rate sensor 139 may include hardware that senses a flow rate of production 121 ($Q_{wh}$) passing through the wellhead 130.

FIG. 2 illustrates, in elevational view, a wellhead, and related components, employed for the wellbore and well control system of FIG. 1, in accordance with one or more embodiments. As such, one or more of the modules and/or elements shown in FIG. 2 may be omitted, repeated, and/or substituted. Accordingly, embodiments of the invention should not be considered limited to the specific arrangements of modules and/or elements shown in FIG. 2.

In accordance with one or more embodiments, FIG. 2 illustrates details of the wellhead 130 and the flowline for the production 121 depicted in FIG. 1 above. As shown, the wellhead 130 includes a well cap 200, a crown valve 201, a wing valve 202, a surface safety valve 203, a master valve 204, a subsurface safety valve 205, an upstream pressure transmitter 206, a downstream pressure transmitter 207, a choke valve 208, and a plot limit valve 209. The crown valve 201, wing valve 202, surface safety valve 203, master valve 204, choke valve 208, and plot limit valve 209 are referred to as valves at the wellhead. In addition, a pressure gauge 210 and/or temperature gauge (not shown) is permanently installed between the crown valve 201 and the well cap 200. The pressure gauge 210 and/or temperature gauge (not shown) correspond to the pressure sensor 136 and temperature sensor 138, respectively, depicted in FIG. 1 above.

In accordance with one or more embodiments, the well cap 200 provides access to wellbore for interventions with wireline, coil tubing, slickline etc. The crown valve 201 is the uppermost valve on wellhead. Typically, the crown valve 201 is closed until there is a need to access the well as described above. The wing valve 202 is for production flow control. In the case of needing to enter a well, this valve would be closed and the master valve would be open. The surface safety valve 203 is typically a hydraulic failsafe close valve located at surface. The surface safety valve 203 used in the event of an issue in the wellbore/surface equipment and for testing. The master valve 204 is the main valve controlling flow from the wellbore. The subsurface safety valve 205 is another safety device located below the surface, e.g., several hundred plus feet below the surface. The subsurface safety valve 205 makes up part of the production tubing and provides an arrangement for safety closure in the case of uncontrolled release of hydrocarbons, such as a kick. Also, the subsurface safety valve 205 may be used as a barrier when testing or needed to perform maintenance on the wellhead.

In accordance with one or more embodiments, the choke valve 208 is used for flow restriction in the event of bleeding down pressure during testing, loss of pressure in the wellbore, temperature management, etc. The upstream pressure transmitter 206 is a pressure/temperature gauge located upstream of choke valve 208 and provides pressure data prior to reaching the choke valve 208. The downstream pressure transmitter 207 is a pressure/temperature gauge downstream of choke valve 208 and provides pressure data after passing the choke valve 208. The plot limit valve 209 is a valve for testing, maintenance and isolation purposes, e.g., if the upstream pressure transmitter 206, downstream pressure transmitter 207, or choke valve 208 were being replaced. The pressure gauge 210 located above the crown valve 201 is for testing each component of the wellhead. Generally, shut-in wellhead pressure (SIWHP) refers to the initial wellhead pressure from the reservoir as seen at surface and is a base line pressure for testing purposes, and can be measured by the pressure gauge 210. The initial manifold pressure refers to the initial pressure downstream of wellhead and is a base line pressure for testing purposes.

In one or more embodiments, the hydraulic valves and associated gauges are connected as depicted in FIG. 2. In particular, a pressure gauge 210 can be permanently installed between the well cap 200 and the crown valve 201. In a first open/close configuration, the subsurface safety valve, master valve, wellhead valve, crown valve, and plot limit valve are closed to record the initial manifold pressure using the downstream pressure transmitter.

Figure 3:
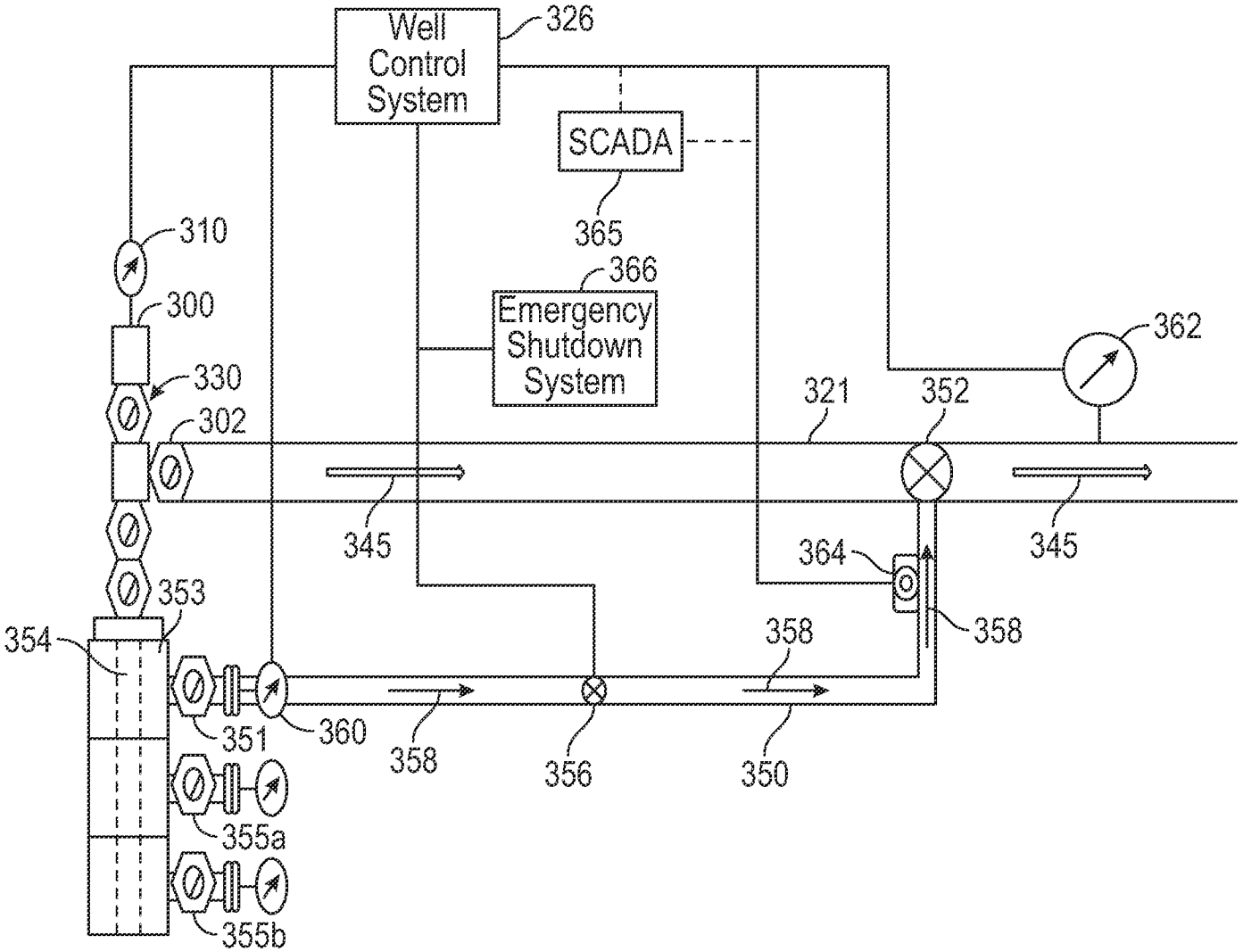
FIG. 3 schematically illustrates, in elevational view, a wellhead and related components in accordance with one or more embodiments.
Figure 4:
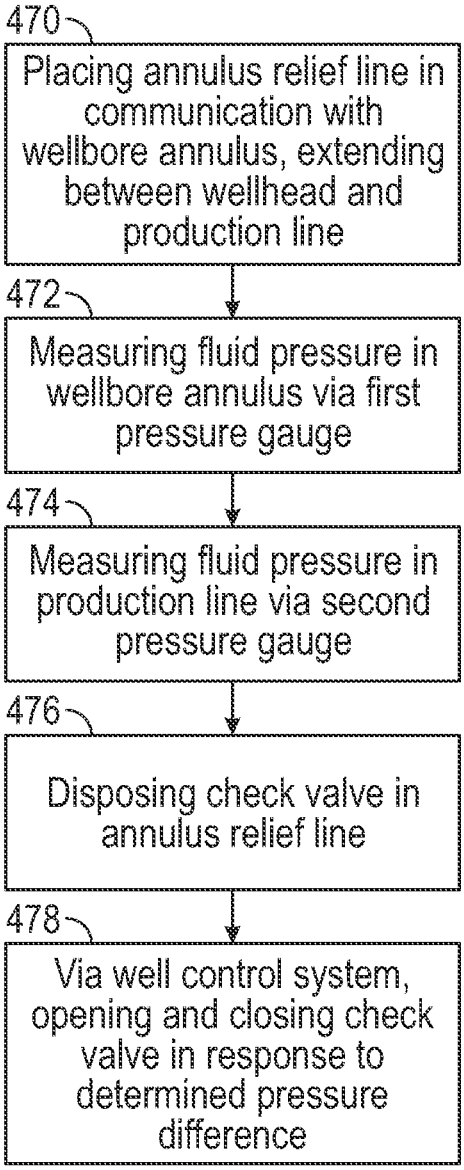
FIG. 4 shows a flowchart of a method in accordance with one or more embodiments.
Figure 5:
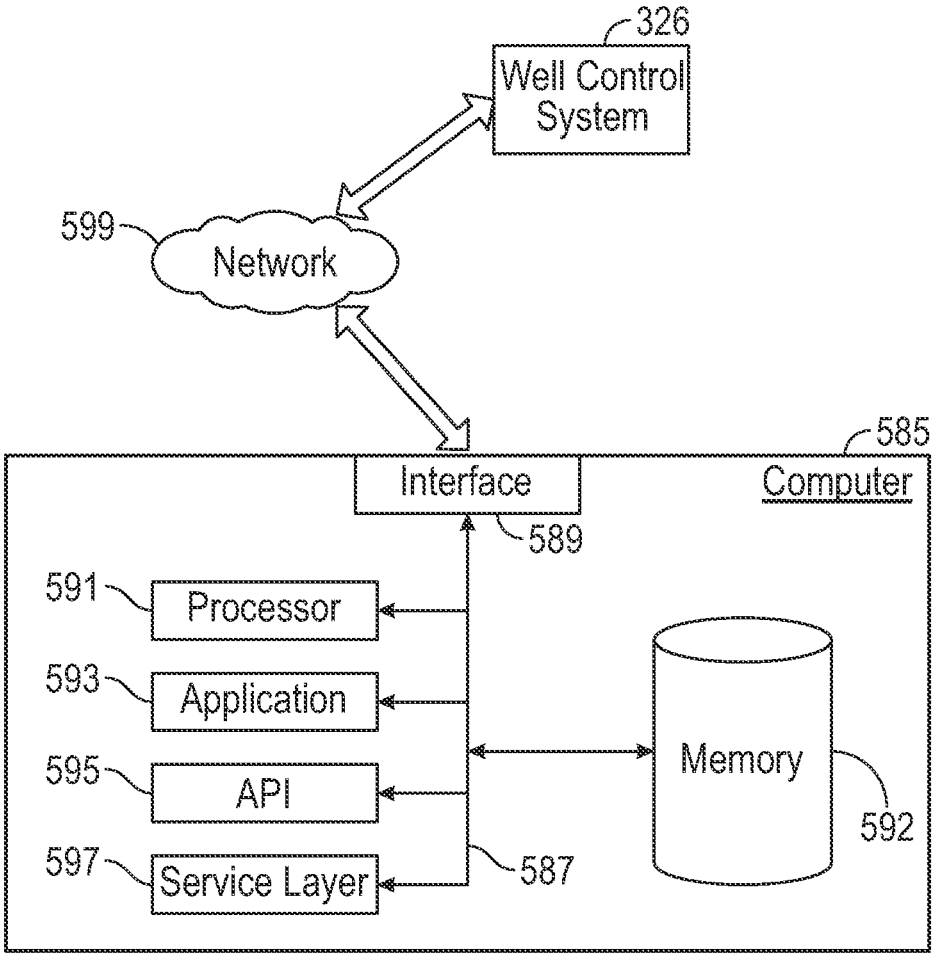
FIG. 5 schematically illustrates a computing device and related components, in accordance with one or more embodiments.

The disclosure now turns to working examples of a system and method in accordance with one or more embodiments, as described and illustrated with respect to FIGS. 3-5. It should be understood and appreciated that these merely represent illustrative examples, and that a great variety of possible implementations are conceivable within the scope of embodiments as broadly contemplated herein.

In accordance with one or more embodiments, FIG. 3 schematically illustrates a wellhead 330, which may include one or more components analogous or similar to the wellhead 130 shown in FIG. 2. As shown, a production line 321 leads away from the wellhead 330 generally and from a wing valve 302 in particular, to direct production fluid flow in the general direction indicated by arrows 345. An annulus relief line 350 is connected to an outlet 351 of a tubing casing annulus and leads to an insertion valve 352 in the production line 321. Insertion valve 352 may include a connection port that admits fluid flow from the annulus relief line to the production line 321 in the direction of arrows 345. A wellhead pressure gauge 310 is also provided at or near a well cap 300, and can be monitored by well control system 326.

As understood herein in accordance with one or more embodiments, and as generally known in the oilfield arts, a tubing casing annulus (or "TCA") may be defined between a casing in a wellbore (such as the wellbore 120 shown in FIG. 1) and tubing nested concentrically therewithin, such as production tubing. Thus, outlet 351 may be in communication with a TCA generally indicated at 353, itself disposed radially outwardly of production tubing 354 (here shown abstractly, merely for purposes of the present discussion, via dotted lines). Other outlets, such as those indicated at 355*a* and 355*b*, may be disposed below outlet 351 and may be in communication with other annuli, not otherwise illustrated or discussed herein, disposed concentrically outwardly of TCA 353.

In accordance with one or more embodiments, the annulus relief line 350 includes a one-way check valve 356 that admits fluid flow solely in the direction indicated by arrows 358. Thus, the check valve 356, acting as a one-way pre-set relief valve, prevents backflow from the production line 321 to the TCA outlet 351 and the TCA 353 itself. (The term "fluid" and its derivatives, as understood herein, can refer to one or more liquids, one or more gases, or a combination of these.)

In this connection, and in accordance with one or more embodiments, check valve 356 admits flow in direction 358 only when fluid pressure in the tubing casing annulus increases by a predetermined amount, such as 100 psi above a pressure downstream in the production line 321. This helps ensure a controlled release of fluid when an integrity issue is encountered in the TCA 353. Pressure in the tubing casing annulus may be measured by a pressure gauge 360, and in the production line 321 via a pressure gauge 362. Measurements thus may be taken from both gauges 360/362, and may be compared via logic associated with well control system 326; for instance, the logic may be internal to well control system 326 or may be housed at a computer such as that described and illustrated with respect to FIG. 5. Responsive to this, control system 326 may then, as appropriate, transmit a suitable actuating signal to open or close the check valve 356. By way of an illustrative example, pressure may be relieved by opening the check valve 356, and leaving it open until the TCA pressure measured by gauge 360 decreases to a level at or near (e.g., equal to) that of the production line pressure measured by gauge 362 (e.g., to a level within a predetermined margin above and below the production line pressure).

In accordance with one or more embodiments, a relief counter 364 is also provided along the annulus relief line 350 between the check valve 356 and the insertion valve 352 The relief counter 364 may take essentially any suitable form, but generally is configured to count the number of times fluid flow passes through the annulus relief line 350 as a result of opening the check valve 356. Especially when correlating with a predetermined time scale, such as a given number of minutes or hours, the counting can assist a production engineer with further analysis.

In this connection, in accordance with one or more embodiments, the counter 364 can include a suitable display to assist in providing direct feedback to an operator regarding any annulus integrity issues owing to a recurrent positive pressure delta inside the tubing casing annulus. Alternatively or in addition, the counter 364 can be in communication with well control system 326 and, in turn, a user interface in communication therewith. In this connection, and merely by way of illustrative example, the counter 364 may be in communication with a SCADA (supervisory control and data acquisition system) 365 that itself may be in communication with, or integrated with, either or both of well control system 326 or a computer such as that described and illustrated with respect to FIG. 5. Thus, the counter 364 may thereby integrate with a data logging arrangement, as a mechanism to track the number of times that check valve 356 is opened and closed in response to pressure changes as noted, and to track the timings and durations of such opening and closing.

In accordance with one or more embodiments, an emergency shutdown system may facilitate automatic shut-in of the well. The emergency shutdown system, indicated schematically at 366, may be a constituent component of well control system 326, or may (as shown) be a separate unit in communication with well control system 326. In either scenario, the well can be automatically shut-in after a predetermined number of fluid releases (as noted) occur within a given period of time, via shutting one or more valves among those described herein with respect to FIGS. 1-3. Predetermined metrics in this connection may be preset via a user interface in communication with well control system 326, depending on the operating context at hand. Generally, the emergency shutdown system may be controlled by logic in the well control system 326, or via a computer such as that described and illustrated with respect to FIG. 5.

Thus, by way of an illustrative working example in accordance with one or more embodiments, if a threshold pressure difference is determined to be exceeded (e.g., if the measurement at gauge 360 is 750 psi and that at gauge 362 is 300 psi), then check valve 356 is opened for pressure relief as discussed above. An opening event can be detected and logged, e.g., via counter 364 and well control 326 system and/or SCADA 365 as discussed above, incorporating the time and duration of the opening event. If a predetermined number of opening events occur within a predetermined time frame (for instance, five opening events of check valve 356 in the space of one hour), then well control system 326 and/or emergency shutdown system 366 can operate to shut-in the well automatically as noted.

It can now be appreciated that, in accordance with one or more embodiments, a closed-loop relief system is also afforded, via which the release of toxic gases to the atmosphere (such as $H_2S$) can be averted. This can accommodate requirements that may be in place for populated fields or fields that are sour (that is, contaminated by sulfur), where release of gases to the atmosphere may be prohibited. Thus, as the TCA pressure, as measured at gauge 360, exceeds the downstream pressure, as measured at gauge 362, by a predetermined amount for a predetermined time, a "bleeding off" operation diverting fluid flow from the TCA 353 to production line 321 will ensure that no toxic gases are emitted to the atmosphere. This contrasts significantly with conventional setups, where a hose may be connected to the TCA 353 (e.g., via outlet 351) to bleed off into a tank, for which additional, more costly measures may need to be taken to prevent the release of toxic gases.

In brief recapitulation, in accordance with one or more embodiments, it can be appreciated that a system as broadly described and contemplated herein provides several advantages in comparison with conventional arrangements. For instance, the counting function provided by counter 364 can help provide a quick and easy point of reference to alert to potential safety issues in a well. At the same time, well control system 326 can automatically activate check valve 356 to bleed off into production line 321 without a need for manual intervention. Automatic shutdown of the well can also occur as a result, until such a time that further analysis can be carried out. Additionally, while it can be appreciated that as a system of TCA pressure relief as described herein can be employed generally in response to excess TCA pressure, it does include a specific benefit of safely diverting one or more toxic gases in certain environments. Thus, actions of TCA pressure relief as described herein can greatly inure to the benefit of operator safety and environmental protection alike.

FIG. 4 shows a flowchart of a method, as a general overview of steps which may be carried out in accordance with one or more embodiments described or contemplated herein. Specifically, FIG. 4 describes a method of relieving pressure in a wellbore annulus of a hydrocarbon recovery well. One or more blocks in FIG. 4 may be performed using one or more components as described in FIGS. 1-3 and 5. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

As such, in accordance with one or more embodiments, an annulus relief line is placed in communication with a wellbore annulus, such that the annulus relief line extends between a wellhead at a wellbore and a production line extending from the wellhead (470). Merely illustrative examples of related components can be appreciated from the wellhead and components shown in FIG. 3. Fluid pressure is measured in the wellbore annulus via a first pressure gauge (472), and in the production line via a second pressure gauge (474). Merely by way of example, such measurements can be made by the pressure gauges 360 and 362, respectively, shown in FIG. 3. A check valve is disposed in the annulus relief line (476). Such a check valve can be embodied by that indicated at 356 in FIG. 3. Via a well control system in communication with the first pressure gauge, second pressure gauge and check valve, the check valve is opened and closed in response to a determined difference between fluid pressure measured by the first pressure gauge and fluid pressure measured by the second pressure gauge (478). The well control system can be embodied by that indicated at 326 in FIG. 3, and can function in a manner as described with relation to FIG. 3.

FIG. 5 schematically illustrates a computing device and related components, in accordance with one or more embodiments. As such, FIG. 5 generally depicts a block diagram of a computer system 585 used to provide computational functionalities associated with described algorithms, methods, functions, processes, flows, and procedures as described in this disclosure, according to one or more embodiments. In this respect, computer 585 may interface with a well control system 326 such as that described and illustrated with respect to FIG. 3, either directly (e.g., via hard-wired connection) or over an internal or external network 599. Further, a dedicated database for storing bottom-hole pressure measurement data may be housed in computer 585 (e.g., in memory 592), or may be housed or stored elsewhere in a manner to be controlled or communicated with by computer 585. Alternatively, the computer 585 illustrated in FIG. 5 may correspond directly to the well control system 326 described and illustrated with respect to FIG. 3.

In accordance with one or more embodiments, the illustrated computer 585 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 585 may include a computer that includes an input device, such as a keypad, keyboard, touch screen, or other device that can accept user information, and an output device that conveys information associated with the operation of the computer 585, including digital data, visual, or audio information (or a combination of information), or a GUI.

The computer 585 can serve in a role as a client, network component, a server, a database or other persistency, or any other component (or a combination of roles) of a computer system for performing the subject matter described in the instant disclosure. The illustrated computer 585 is communicably coupled with a network 599. In some implementations, one or more components of the computer 585 may be configured to operate within environments, including cloud-computing-based, local, global, or other environment (or a combination of environments).

At a high level, the computer 585 is an electronic computing device operable to receive, transmit, process, store, or manage data and information associated with the described subject matter. According to some implementations, the computer 585 may also include or be communicably coupled with an application server, e-mail server, web server, caching server, streaming data server, business intelligence (BI) server, or other server (or a combination of servers).

The computer 585 can receive requests over network 599 from a client application (for example, executing on another computer 585) and responding to the received requests by processing the said requests in an appropriate software application. In addition, requests may also be sent to the computer 585 from internal users (for example, from a command console or by other appropriate access method), external or third-parties, other automated applications, as well as any other appropriate entities, individuals, systems, or computers.

Each of the components of the computer 585 can communicate using a system bus 587. In some implementations, any or all of the components of the computer 585, both hardware or software (or a combination of hardware and software), may interface with each other or the interface 589 (or a combination of both) over the system bus 587 using an application programming interface (API) 595 or a service layer 597 (or a combination of the API 595 and service layer 597. The API 595 may include specifications for routines, data structures, and object classes. The API 595 may be either computer-language independent or dependent and refer to a complete interface, a single function, or even a set of APIs. The service layer 597 provides software services to the computer 585 or other components (whether or not illustrated) that are communicably coupled to the computer 585. The functionality of the computer 585 may be accessible for all service consumers using this service layer. Software services, such as those provided by the service layer 597, provide reusable, defined business functionalities through a defined interface. For example, the interface may be software written in JAVA, C++, or other suitable language providing data in extensible markup language (XML) format or another suitable format. While illustrated as an integrated component of the computer 585, alternative implementations may illustrate the API 595 or the service layer 597 as stand-alone components in relation to other components of the computer 585 or other components (whether or not illustrated) that are communicably coupled to the computer 585. Moreover, any or all parts of the API 595 or the service layer 597 may be implemented as child or sub-modules of another software module, enterprise application, or hardware module without departing from the scope of this disclosure.

The computer 585 includes an interface 589. Although illustrated as a single interface 589 in FIG. 5, two or more interfaces 589 may be used according to particular needs, desires, or particular implementations of the computer 585. The interface 589 is used by the computer 585 for communicating with other systems in a distributed environment that are connected to the network 599. Generally, the interface 589 includes logic encoded in software or hardware (or a combination of software and hardware) and operable to communicate with the network 599. More specifically, the interface 589 may include software supporting one or more communication protocols associated with communications such that the network 599 or interface's hardware is operable to communicate physical signals within and outside of the illustrated computer 585.

The computer 585 includes at least one computer processor 591. Although illustrated as a single computer processor 591 in FIG. 5, two or more processors may be used according to particular needs, desires, or particular implementations of the computer 585. Generally, the computer processor 591 executes instructions and manipulates data to perform the operations of the computer 585 and any algorithms, methods, functions, processes, flows, and procedures as described in the instant disclosure.

The computer 585 also includes a memory 592 that holds data for the computer 585 or other components (or a combination of both) that can be connected to the network 599. For example, memory 592 can be a database storing data consistent with this disclosure. Although illustrated as a single memory 592 in FIG. 5, two or more memories may be used according to particular needs, desires, or particular implementations of the computer 585 and the described functionality. While memory 592 is illustrated as an integral component of the computer 585, in alternative implementations, memory 592 can be external to the computer 585.

The application 593 is an algorithmic software engine providing functionality according to particular needs, desires, or particular implementations of the computer 585, particularly with respect to functionality described in this disclosure. For example, application 593 can serve as one or more components, modules, applications, etc. Further, although illustrated as a single application 593, the application 593 may be implemented as multiple applications 593 on the computer 585. In addition, although illustrated as integral to the computer 585, in alternative implementations, the application 593 can be external to the computer 585.

There may be any number of computers 585 associated with, or external to, a computer system containing computer 585, wherein each computer 585 communicates over network 599. Further, the term "client," "user," and other appropriate terminology may be used interchangeably as appropriate without departing from the scope of this disclosure. Moreover, this disclosure contemplates that many users may use one computer 585, or that one user may use multiple computers 585.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for relieving pressure in a wellbore annulus of a hydrocarbon recovery well, said system comprising:

a wellhead disposed at a wellbore;

the wellhead including a wing valve;

a production line extending from the wellhead;

the production line including an insertion valve;

an annulus relief line in communication with the wellbore annulus, wherein the annulus relief line extends between the wing valve and the insertion valve;

a first pressure gauge that measures fluid pressure in the wellbore annulus;

a second pressure gauge that measures fluid pressure in the production line;

a one-way check valve that is disposed in the annulus relief line between the wing valve and the insertion valve and that prevents backflow from the production line to the annulus;

a counter disposed on the annulus relief line between the check valve and the insertion valve; and a well control system in communication with the first pressure gauge, second pressure gauge and check valve, wherein the well control system opens and closes the check valve in response to a determined difference between fluid pressure measured by the first pressure gauge and fluid pressure measured by the second pressure gauge, and wherein the counter:

is configured to count instances of fluid flow through the annulus relief line as a result of opening the check valve, is configured to communicate, to the well control system and a supervisory control and data acquisition system (SCADA), a count of a predetermined number of instances of fluid flow through the annulus relief line, and includes a display that provides direct feedback to an operator regarding annulus integrity issues.

2. The system according to claim 1, wherein the well control system opens the check valve when the fluid pressure measured by the first pressure gauge is a predetermined amount greater than the fluid pressure measured by the second pressure gauge.

3. The system according to claim 2, wherein the well control system closes the check valve when the fluid pressure measured by the first pressure gauge decreases to a level within a predetermined margin of the fluid pressure measured by the second pressure gauge.

4. The system according to claim 3, further comprising:

an emergency shutdown system in communication with the well control system;

wherein the emergency shutdown system is configured to shut-in the well after the predetermined number of instances of fluid flow through the annulus relief line and within a predetermined period of time.

5. The system according to claim 4, wherein the annulus is a tubing casing annulus disposed between a wellbore casing and production tubing.

6. The system according to claim 5, wherein the well control system opens the check valve when the fluid pressure measured by the first pressure gauge is 100 psi greater than the fluid pressure measured by the second pressure gauge.

7. The system according to claim 6, wherein the well control system closes the check valve when the fluid pressure measured by the first pressure gauge decreases to a level equal to the fluid pressure measured by the second pressure gauge.

8. A method comprising:

placing an annulus relief line in communication with a wellbore annulus, such that the annulus relief line extends between a wellhead at a wellbore and a production line extending from the wellhead, wherein the wellhead includes a wing valve and the production line includes an insertion valve, and the annulus relief line extends between the wing valve and the insertion valve;

measuring fluid pressure in the wellbore annulus via a first pressure gauge;

measuring fluid pressure in the production line via a second pressure gauge;

disposing a one-way check valve in the annulus relief line between the wing valve and the insertion valve, wherein the check valve prevents backflow from the production line to the annulus;

disposing a counter on the annulus relief line between the check valve and the insertion valve, the counter including a display that provides direct feedback to an operator regarding annulus integrity issues; and via a well control system in communication with the first pressure gauge, second pressure gauge and check valve, opening and closing the check valve in response to a determined difference between fluid pressure measured by the first pressure gauge and fluid pressure measured by the second pressure gauge; and using the counter to:

count instances of fluid flow through the annulus relief line as a result of opening the check valve, and communicate, to the well control system and a supervisory control and data acquisition system (SCADA), a count of a predetermined number of instances of fluid flow through the annulus relief line.

9. The method according to claim 8, wherein opening and closing the check valve comprises opening the check valve when the fluid pressure measured by the first pressure gauge is a predetermined amount greater than the fluid pressure measured by the second pressure gauge.

10. The method according to claim 9, wherein opening and closing the check valve comprises closing the check valve when the fluid pressure measured by the first pressure gauge decreases to a level within a predetermined margin of the fluid pressure measured by the second pressure gauge.

11. The method according to claim 10, further comprising:

providing an emergency shutdown system in communication with the well control system; and configuring the emergency shutdown system to shut-in the well after the predetermined number of instances of fluid flow through the annulus relief line and within a predetermined period of time.

12. The method according to claim 11, wherein:

the annulus is a tubing casing annulus disposed between a wellbore casing and production tubing.

13. The method according to claim 12, wherein:

the well control system opens the check valve when the fluid pressure measured by the first pressure gauge is 100 psi greater than the fluid pressure measured by the second pressure gauge; and the well control system closes the check valve when the fluid pressure measured by the first pressure gauge decreases to a level equal to the fluid pressure measured by the second pressure gauge.

* * * * *